US007057570B2

(12) United States Patent
Irion, II et al.

(10) Patent No.: US 7,057,570 B2
(45) Date of Patent: Jun. 6, 2006

(54) METHOD AND APPARATUS FOR OBTAINING WIDEBAND PERFORMANCE IN A TAPERED SLOT ANTENNA

(75) Inventors: James M. Irion, II, Plano, TX (US); Nicholas A. Schuneman, Cambridge, MA (US)

(73) Assignee: Raytheon Company, Waltham, MA (US)

( * ) Notice: Subject to any disclaimer, the term of this patent is extended or adjusted under 35 U.S.C. 154(b) by 162 days.

(21) Appl. No.: 10/695,021

(22) Filed: Oct. 27, 2003

(65) Prior Publication Data

US 2005/0088353 A1 Apr. 28, 2005

(51) Int. Cl.
*H01Q 13/10* (2006.01)

(52) U.S. Cl. ..... 343/770; 343/725

(58) Field of Classification Search ..... 343/725, 343/729, 767, 776, 770
See application file for complete search history.

(56) References Cited

U.S. PATENT DOCUMENTS 3,786,372 A 1/1974 Epis et al. ..... 333/26
5,461,392 A * 10/1995 Mott et al. ..... 343/725
5,519,408 A * 5/1996 Schnetzer ..... 343/767
6,043,785 A * 3/2000 Marino ..... 343/767
6,501,431 B1 * 12/2002 Irion et al. ..... 343/767
6,538,614 B1 * 3/2003 Fleming et al. ..... 343/767

FOREIGN PATENT DOCUMENTS

EP 1 102 349 A2 5/2001
GB 2 281 662 A 3/1995
JP P2002-217617 A 8/2002

OTHER PUBLICATIONS

J. Shin and D.H. Schaubert, "A Parameter Study of Stripline-Fed Vivaldi Notch-Antenna Arrays," IEEE Transactions on Antennas and Propagation, vol. 47, No. 5, pp. 879-886, May 1999.
N. Schuneman, J. Irion and R. Hodges, "Decade Bandwidth Tapered Notch Antenna Array Element," 15 pgs.
PCT Notification of Transmittal of the International Search Report and the Written Opinion of the International Searching Authority, or the Declaration for International Application No. PCT/US2004/034858, Apr. 27, 2005.

* cited by examiner

*Primary Examiner*—Shih-Chao Chen
(74) *Attorney, Agent, or Firm*—Baker Botts L.L.P.

(57) ABSTRACT

An apparatus includes a slot defined by electrically conductive material, an electrically conductive element extending generally transversely to the slot in the region of a first end thereof, and a balun portion communicating with the first end of the slot, the balun portion having a high impedance and being configured to provide a selected degree of absorption of electromagnetic energy.

31 Claims, 4 Drawing Sheets

METHOD AND APPARATUS FOR OBTAINING WIDEBAND PERFORMANCE IN A TAPERED SLOT ANTENNA

FIELD OF THE INVENTION

This invention relates in general to tapered slot antennas and, more particularly, to a method and apparatus for obtaining wideband performance in a tapered slot antenna.

BACKGROUND OF THE INVENTION

During recent years, there has been an increase in the use of antennas that include an array of antenna elements, one example of which is a phased array antenna. Antennas of this type have many applications in commercial and defense markets, such as communication and radar systems. In many of these applications, broadband performance is desirable. In this regard, some of these antennas are designed so that they can be switched between two or more discrete frequency bands. Thus, at any given time, the antenna is operating in only one of these multiple bands. However, in order to achieve true broadband operation, an antenna needs to be capable of satisfactory operation in a single wide frequency band, without the need to switch between two or more discrete frequency bands.

One type of antenna element that has been found to work well in an array antenna is commonly referred to as a tapered slot antenna element. The spacing between antenna elements in an array antenna is inversely proportional to the frequency at which the antenna operates, and a tapered slot antenna element fits comfortably within the space available for antenna elements in many array antennas, including those which operate at high frequencies.

Tapered slot antenna elements typically have a bandwidth of about 3:1 or 4:1, although some very recent designs have achieved a maximum bandwidth of about 10:1, or in other words one decade. While these existing tapered slot antenna elements have been generally adequate for their intended purposes, they have not been satisfactory in all respects. In this regard, there are applications in which it is desirable for a tapered slot antenna element to provide good performance across a bandwidth in the range of approximately two to four decades, or even more. Existing designs and design techniques have not been able to provide a tapered slot antenna element which approaches this desired level of broadband performance.

SUMMARY OF THE INVENTION

From the foregoing, it may be appreciated that a need has arisen for a method and apparatus that contribute to a greater bandwidth than is currently available in pre-existing antenna elements. One form of the present invention relates to an apparatus which includes a slot section having electrically conductive material that defines a slot with first and second ends, an electrically conductive element extending generally transversely to the slot in the region of the first end thereof, and a balun portion communicating with the first end of the slot. The method and apparatus involve: configuring the balun portion to have a high impedance; and absorbing a selected degree of electromagnetic energy in the balun portion.

BRIEF DESCRIPTION OF THE DRAWINGS

A better understanding of the present invention will be realized from the detailed description which follows, taken in conjunction with the accompanying drawings, in which.

DETAILED DESCRIPTION

Figure 1:
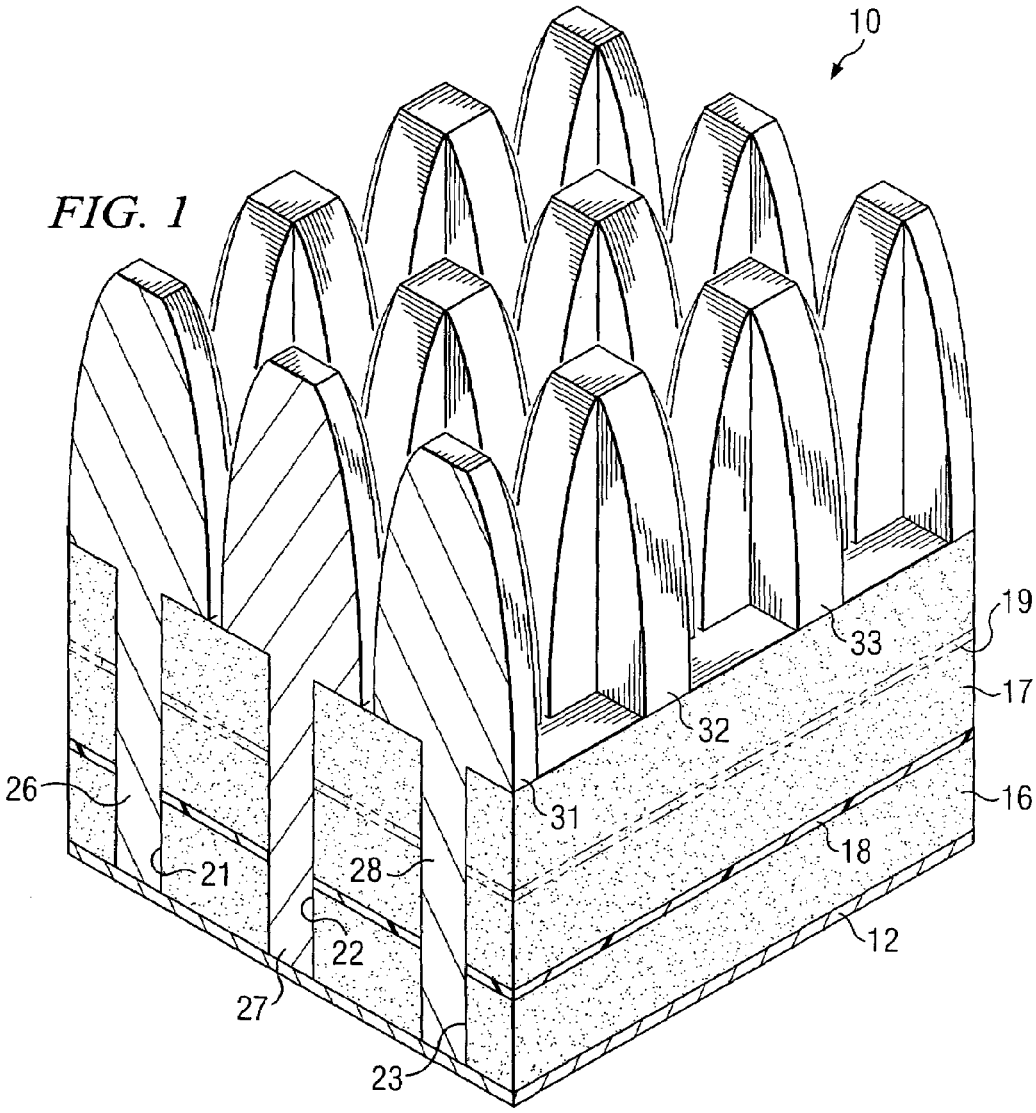
FIG. 1 is a diagrammatic fragmentary perspective view of an apparatus which is part of an array antenna, and which embodies aspects of the present invention.

FIG. 1 is a diagrammatic fragmentary perspective view of an apparatus which is part of an array antenna 10, and which embodies aspects of the present invention. The array antenna 10 in FIG. 1 can both transmit and receive signals. For convenience and clarity, the following discussion is presented in the context of transmitting signals rather than receiving signals. The array antenna 10 includes a conductive metal plate which serves as a ground plane layer 12. Instead of metal, the layer 12 could alternatively be made from any other suitable material which is electrically conductive.

Two filler layers 16 and 17 are provided above the ground plane layer 12, and are made from a material having a low dielectric constant. In the disclosed embodiment, the layers 16 and 17 are made from a foam which can be obtained commercially under the trademark AIREX from Baltek Corporation of Northvale, N.J., as catalog number R82. However, it would alternatively be possible to use any other suitable material. In the embodiment of FIG. 1, the foam layer 17 is approximately twice as thick as the foam layer 16. However, other thicknesses could be used.

A layer or sheet 18 of a resistive material is provided between the foam layers 16 and 17, and is oriented parallel to the ground plane layer 12. In the disclosed embodiment, the resistive sheet 18 has a resistance of approximately 360 ohms per square, and provides a selected degree of absorption of electromagnetic energy, as discussed later. A suitable material for the sheet 18 can be obtained commercially from SV Microwave, Inc., of West Palm Beach, Fla., in the form of a resistance coated metal film on 2 mil Kapton. It would alternatively be possible to use any other suitable material that provides an appropriate degree of absorption of electromagnetic energy.

In the embodiment of FIG. 1, there is a single resistive sheet 18 within the foam material 16–17. However, it would alternatively be possible to provide two or more resistive sheets within the foam material. As one example, and as indicated diagrammatically by broken lines at 19, a second resistive sheet could be provided within the foam material at a vertical location which is approximately in the middle of the foam layer 17. Also, the resistive sheet 18 is parallel to the ground plane layer 12 in FIG. 1, but it would alternatively be possible to use a different orientation and/or configuration of energy-absorbing material in place of the sheet 18.

The array antenna 10 has a plurality of cylindrical openings extending vertically through the foam layers 16–17 and the resistive sheet 18, and three of these openings are visible at 21, 22 and 23 in FIG. 1. A plurality of electrically conductive cylindrical posts each extend vertically through a respective one of these openings, and three of these posts are visible at 26, 27 and 28 in FIG. 1. Each post has its lower end electrically coupled to the metal plate which serves as the ground plane layer 12. Although the posts and associated openings are cylindrical in the disclosed embodiment, they could alternatively have some other shape.

The array antenna 10 has, above the foam layer 17, a plurality of electrically conductive flare elements, three of which are designated by reference numerals 31, 32 and 33. In the embodiment of FIG. 1, each flare element is integral with a respective one of the cylindrical posts. For example, the post 28 is integral with the flare element 31, and the post 28 extends vertically downwardly from the center of the bottom surface of the flare element 31. In the embodiment of FIG. 1, the flare elements and their posts are made from a conductive metal such as aluminum or magnesium, but could alternatively be made of some other material or in some other manner. For example, each flare element and its post could have a core made of injection molded plastic, and a thin external coating of an electrically conductive metal. The portion of the array antenna 10 disposed above the top surface of the foam layer 17 is a slot section, which includes the flare elements, but not their associated posts.

Figure 2:
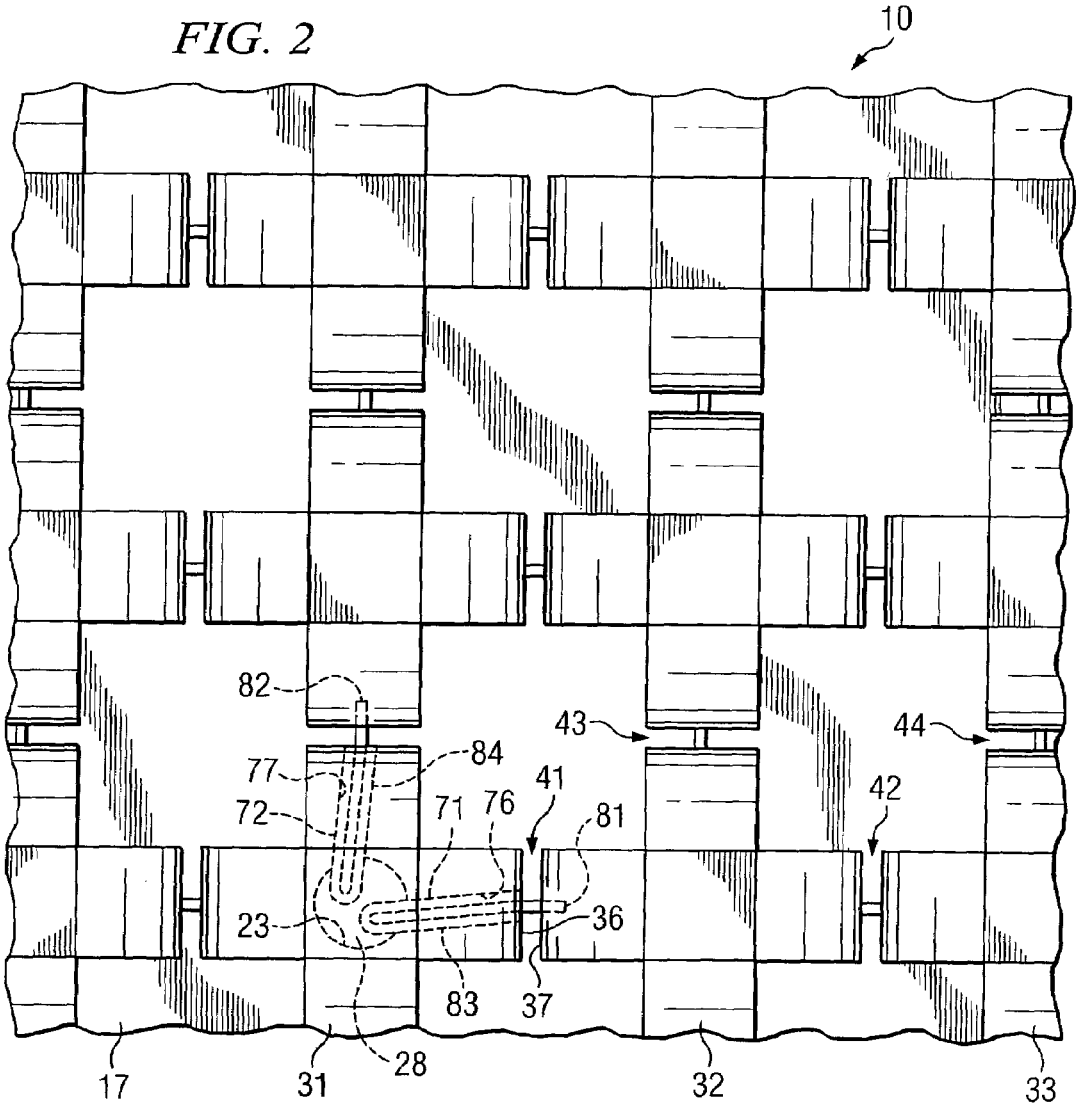
FIG. 2 is a diagrammatic fragmentary top view of part of the array antenna of FIG. 1.
Figure 3:
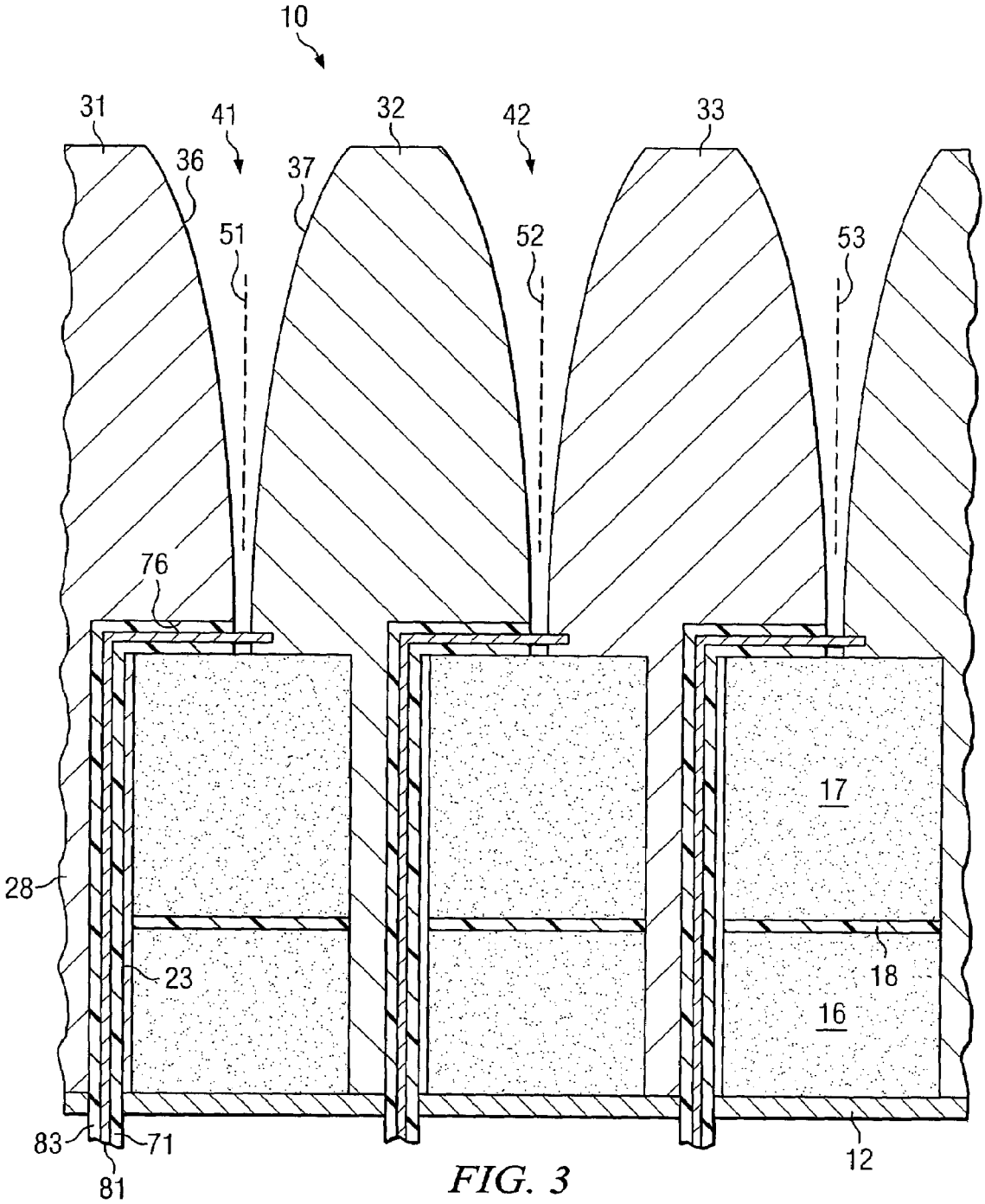
FIG. 3 is a diagrammatic fragmentary sectional side view of a portion of the array antenna of FIG. 1.

FIG. 2 is a diagrammatic fragmentary top view of part of the array antenna 10 of FIG. 1. The three flare elements 31–33 are visible in the lower portion of FIG. 2. FIG. 3 is a diagrammatic fragmentary sectional side view of a portion of the array antenna 10 of FIG. 1, taken through the geometric center of each of the flare elements 31–33. In the disclosed embodiment, each flare element and associated post is identical to every other flare element and post.

In a top view, each flare element has the shape of a regular cross, with four identical legs. As evident from FIG. 3, each leg has a horizontal dimension which decreases progressively in length from the lower end of the leg to the upper end thereof. Thus, the surface at the outer end of each leg is progressively tapered. For example, reference numerals 36 and 37 designate the tapered surfaces on the outer ends of two legs that are respectively provided on the flare elements 31 and 32. At their lower ends, the surfaces 36 and 37 are spaced a small distance from each other, and at their upper ends the surfaces 36 and 37 are spaced a larger distance from each other. A tapered slot 41 is thus formed between the surfaces 36 and 37. Reference numerals 42-44 designate other similar slots in the antenna array 10. Although the slots in the disclosed embodiment have a progressive taper from one end to the other, each slot could alternatively have any of a variety of other shapes.

Each of the slots in the array antenna 10 have a vertical center line, for example as indicated diagrammatically at 51–53 in FIG. 3, and these center lines are all parallel to each other. With reference to the top view of FIG. 2, it will be noted that the slots 41 and 42 are parallel to each other, whereas the slots 43 and 44 are parallel to each other but perpendicular to the slots 41 and 42.

Figure 4:
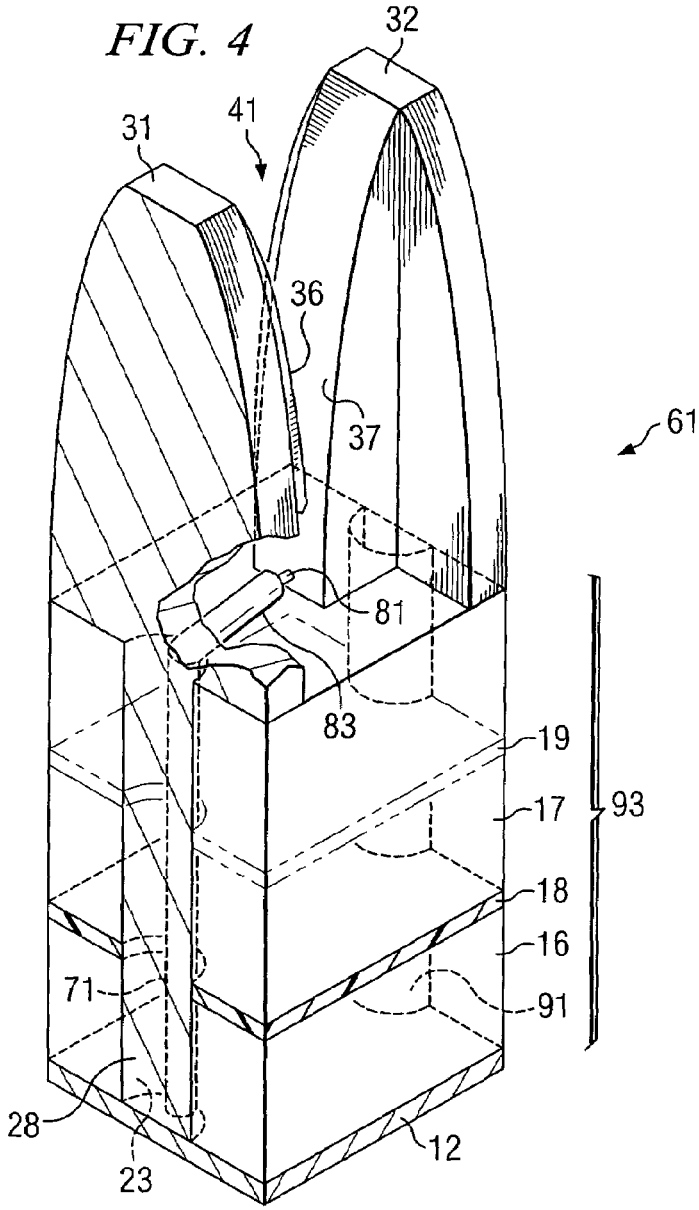
FIG. 4 is a diagrammatic perspective view of a unit cell which is a portion of the array antenna of FIG. 1.

FIG. 4 is a diagrammatic perspective view of a unit cell 61, which is a portion of the array antenna 10 of FIG. 1. The unit cell 61 is centered around one slot, which in this case is the slot 41. The conductive vertical posts in the array antenna 10, such as the posts shown at 26–28 in FIG. 1, are all identical. Consequently, only one of these posts is described here in detail, which is the post 28. With reference to FIGS. 2–4, two coaxial cables 71 and 72 extend through respective spaced holes in the plate 12, and then extend through respective spaced vertical openings provided through the post 28. At the upper end of the post 28, the coaxial cables 71 and 72 each have a right-angle bend. The upper ends of the cables 71 and 72 then extend horizontally outwardly in respective directions which are approximately perpendicular. The bottom surface of the flare element 31 has two grooves 76 and 77, which each receive the horizontal portion of a respective one of the cables 71 and 72.

The cables 71 and 72 have respective center conductors 81 and 82, which are concentrically surrounded by respective sleeves 83 and 84 made of an insulating material. In the disclosed embodiment, the conductive metal material of each post and flare element serves as an outer shield for the coaxial cables. However, it would alternatively be possible to provide a separate outer shield, and an additional layer of insulation could be provided around the outer shield.

At the upper and outer end of each of the cables 71 and 72, the center conductor 81 or 82 has an end portion which extends horizontally across the lower end of a respective slot, closely adjacent the top surface of the foam layer 17. The tip of the outer end of each such center conductor is received within an opening in another flare element. For example, the cable 71 extends upwardly through the post 28 and then horizontally through the groove 76 in the flare element 31, and the tip of its center conductor 81 is received in an opening in the flare element 32. In the disclosed embodiment, the tip of each center conductor is secured in the associated opening of a flare element by solder, so as to electrically couple the flare element to the tip of the center conductor. The center conductor is the only portion of each cable which extends across one of the slots and into an opening in a flare element.

FIG. 4 shows a portion of the post 28, and also a portion of further post 91, the post 91 being coupled to the flare element 32. Below the slot 41 in FIG. 4 is a balun 93 for the slot 41. The balun 93 includes the portions of the foam layers 16 and 17, the resistive layer 18, the ground layer 12 and the posts 28 and 91 which are visible in FIG. 4. It will be noted that the bottom edges of the flare elements 31 and 32, the illustrated portions of the posts 28 and 91, and the illustrated portion of the ground layer 12 collectively form a conductive loop, which extends around the illustrated portions of the resistive layer 18 and the foam layers 16–17. This conductive loop is electrically continuous, except where it communicates with the lower end of the slot 41.

With reference to FIG. 4, when an electrical signal is applied to the lower end of the center conductor 81 of the cable 71, it travels up the cable to the outer end of the center conductor 81, which extends across the lower end of the slot 41. Here, the electrical signal generates an electromagnetic field, which tends to try to travel in opposite directions within the "slotline" defined by the slot 41. The slotline increases approximately progressively in impedance from its lower end to its upper end, from an impedance of approximately 50 ohms in the region of its lower end to an impedance of approximately 377 ohms at its upper end. Persons skilled in the art will recognize that these impedances are exemplary, and could be different. In this regard, the lower the feed impedance the higher the efficiency, and thus a feed impedance of 35 ohms rather than 50 ohms would be beneficial. But a feed arrangement of 50 ohms is fairly typical in the art, and is thus the impedance selected for the disclosed embodiment.

A not-illustrated circuit of a known type is coupled to the lower end of the coaxial cable 71, and the cable 71 is matched in impedance to this circuit, so as to provide a substantially uniform impedance of approximately 50 ohms from the circuit through the cable 71 to the lower end of the slot 41. The slot 41 effects an impedance transformation from a value of approximately 50 ohms at its lower end (which is matched to the impedance of the cable 71), to a value of approximately 377 ohms at the upper end (which is effectively matched to the impedance of free space).

The balun 93 is configured to provide a relatively high impedance of at least several hundred ohms, which represents a relatively large discontinuity in relation to the 50 ohm impedance at the lower end of the slot 41. As noted above, electromagnetic fields generated by the center conductor 81 within the slot 41 will tend to want to split and travel both upwardly and downwardly within the slot 41. However, the large impedance discontinuity at the junction of the balun 93 and the lower end of the slot 41 will cause the majority of this electromagnetic energy to travel upwardly rather than downwardly within the slot 41, and to thus be transmitted upwardly through the slot and then into free space from the upper end of the slot.

In pre-existing systems, balun configurations were specifically designed with the intent of taking the energy received in a slot antenna element, and transmitting as much of this energy as possible through the slot and into free space. This was considered logical in order to maximize the efficiency of the antenna element. However, a feature of the present invention is the recognition that this also tended to limit the bandwidth of the antenna element, for example to a maximum bandwidth of approximately one decade. Consequently, a feature of the invention is that the balun 93 in FIG. 4 has been intentionally configured so that it absorbs a portion of the energy introduced into the slot 41 by the center conductor 81 of the cable 71.

In particular, the foam layers 16 and 17 have a low dielectric constant and are thus effectively transparent to radio frequency (RF) energy. On the other hand, the resistive sheet 18 serves as a lossy material which is intentionally configured to absorb a predetermined portion of the energy introduced into the slot 41 from the center conductor 81. The amount of this energy which is absorbed by the sheet 18 is within a range of approximately 5% to 20%, and preferably within a range of approximately 9% to 15%. In the embodiment of FIG. 4, the portion of the energy which is absorbed by the sheet 18 is selected to be approximately 12%. This absorption of electromagnetic energy by the sheet 18 functions to increase bandwidth, and yet neither the balun 93 nor its absorptive sheet 18 takes up a prohibitive vertical depth.

Figure 5:
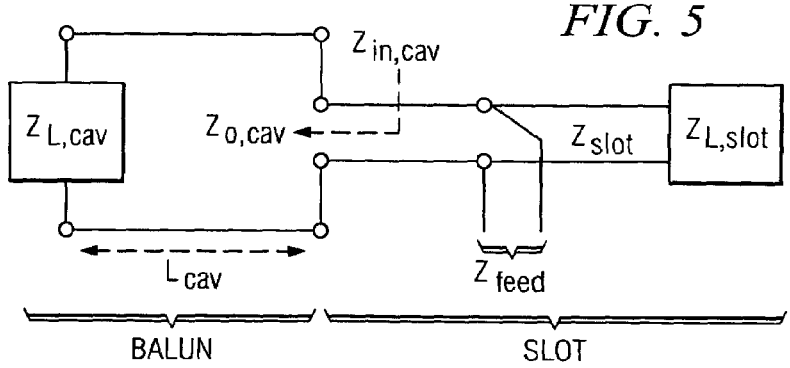
FIG. 5 is a diagram showing a generalized slot and balun that are representative of portions of the antenna array of FIG. 1, where the balun is in an ideal matched-load condition.

With respect to the increased bandwidth resulting from the absorption of energy by the sheet 18, an explanation of the underlying theory will be provided with reference to FIG. 5, which is a diagrammatic representation of a generalized slot and balun, where the balun is in an ideal matched-load condition (which is very close to an operating condition where a long tapered slot is provided at the balun output port). In relation to the circuit shown in FIG. 5, $Z_{feed}$ is used to refer to the input line characteristic impedance, $Z_{slot}$ is used to refer to the balun output slotline characteristic impedance, $Z_{o,cav}$ is used to refer to the slotline cavity characteristic impedance, $Z_{L,cav}$ is used to refer to the cavity termination impedance, $Z_{L,slot}$ is used to refer to the output load impedance (which is an approximation of a well-matched slot radiator), and $Z_{in,cav}$ is used to refer to the cavity "look-in" impedance. To obtain maximum balun bandwidth, $Z_{in,cav}$ should be as large as possible over the largest possible bandwidth, while $Z_{slot}$ should be kept approximately equal to $Z_{feed}$. The value of $Z_{in,cav}$ can be expressed with the following equation:

$$Z_{in,cav} = Z_{o,cav}\frac{Z_{L,cav} + j\,Z_{o,cav}\tan(\beta L_{cav})}{Z_{o,cav} + j\,Z_{L,cav}\tan(\beta L_{cav})} \tag{1}$$

In the case of pre-existing quarter-wave stub and open-circuit cavity balun designs, where the cavity load impedance $Z_{L,cav}$ is a short circuit, the equation for $Z_{in,cav}$ reduces to:

$$Z_{in,cav}=jZ_{o,cav}\tan(\beta L_{cav}) \tag{2}$$

The performance of a balun with the input cavity impedance given by Equation (2) is determined by the magnitude of the cavity characteristic impedance and the cavity length. However, it is clear that, for any finite characteristic impedance, it will be the case that $Z_{in,cav}=0$ at $L_{cav}=n\lambda/4$, n=0,1,2 . . . Thus, baluns with a short-circuit termination possess both upper and lower limits on the operating frequency band.

In the case of a high-impedance balun, the cavity load impedance is no longer a short circuit. Ideally, it is desirable to set the load impedance so that it exactly equals the cavity characteristic impedance, which for this discussion is selected to be 377 Ω (the highest possible impedance in a square-lattice array). This reduces Equation (1) to:

$$Z_{in,cav}=Z_{o,cav}=377\Omega \tag{3}$$

As is evident from Equation (3), a matched-load balun termination eliminates the theoretical bandwidth limits on the balun performance. In an ideal world, it should theoretically be possible to terminate a balun with a high-impedance load and obtain limitless bandwidth. In the ideal case of a 377Ω load and a 50Ω system impedance, a high-impedance balun should transmit 88% of the incident power into the slot, and the remaining 12% should be either reflected at the junction, or dissipated in the high-impedance load.

The embodiment of FIGS. 1–4 is a practical implementation which corresponds to this equivalent circuit model, and provides a balun that maintains high cavity look-in impedance over an extremely broad bandwidth, through the provision of a radio-frequency attenuating material in the balun, in the form of the resistive sheet 18. This essentially forms a resistive current loop in the balun cavity, which absorbs most of the energy in the cavity. One significant feature of the disclosed design is that there is a groundplane at the back of the balun cavity, which prevents back-directed radiation.

Although as mentioned above the bandwidth should ideally be limitless, practical limits in the materials and size of the balun load serve to effectively limit the bandwidth performance. Consequently, the disclosed embodiment provides a bandwidth in excess of approximately 35:1 at an efficiency in excess of 88%. However, electromagnetic effects (such as wave reflection off the air-load resistor interface) can be optimized in order to provide better than optimal performance within the band.

Figure 6:
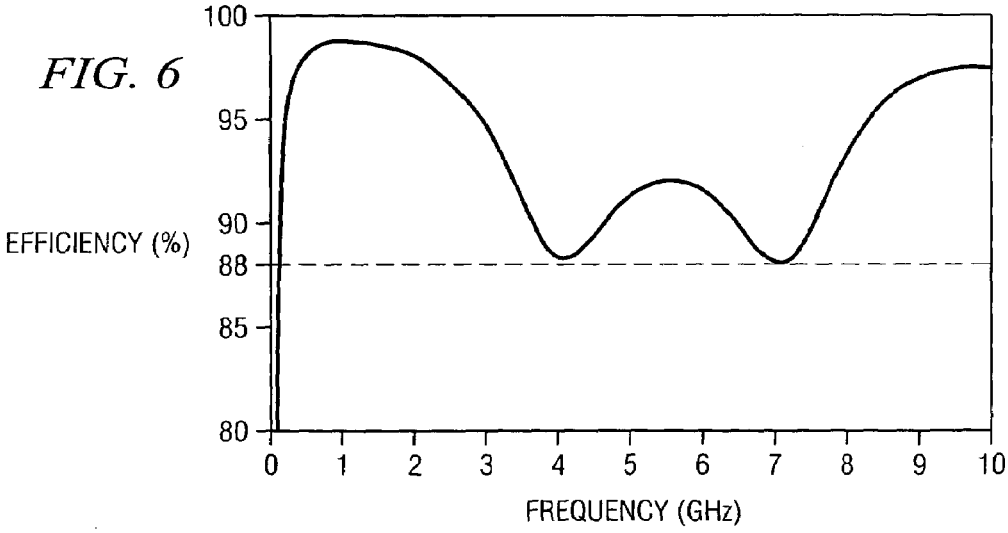
FIG. 6 is a graph showing transmission efficiency performance in relation to frequency for a portion of the embodiment of FIG. 1.

FIG. 6 is a graph showing the transmission efficiency performance of one of the balun portions in the embodiment of FIGS. 1–4, and reflects bandwidth in excess of 35:1 at an efficiency in excess of 88%. In this regard, the graph of FIG.

Figure 7:
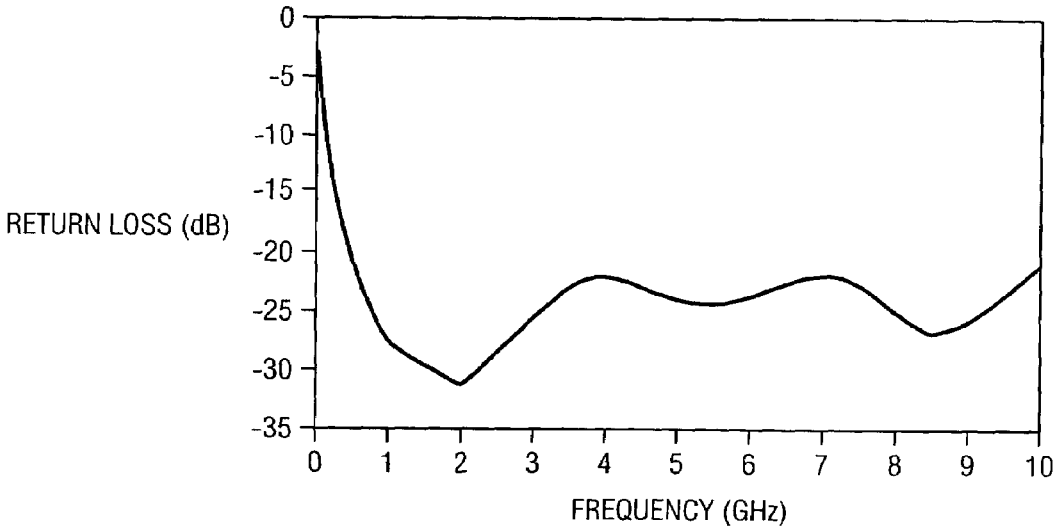
FIG. 7 is a graph showing a return loss characteristic in relation to frequency for the embodiment of FIG. 1.

6 is based on a computer model of the disclosed balun, which is similar to the structure shown in FIG. 3, except that the slot in the computer model has along its entire length a substantially constant width which corresponds to a slot impedance of 50 ohms. As noted above, the disclosed balun can be used with a variety of different slot configurations, and the focus of the graph of FIG. 6 is the performance of the balun. FIG. 7 is a graph showing for the same computer model that the return loss for the embodiment of FIGS. 1–4 is well below −10 dB throughout the same frequency range as the graph of FIG. 6.

The present invention provides a number of advantages. One such advantage is the provision of a broadband balance-to-unbalanced transition that operates over a multi-decade frequency band. The bandwidth is at least two to four times as broad as the best known previous design. This is achieved through the provision of a lossy or absorbing material within a balun, so as to provide a high look-in impedance throughout a bandwidth of two or more decades.

Although one embodiment has been illustrated and described in detail, it will be understood that various substitutions and alterations are possible without departing from the spirit and scope of the present invention, as defined by the following claims.

What is claimed is:

1. An apparatus, comprising:

a slot section having electrically conductive material which defines a slot with first and second ends;

an electrically conductive element extending generally transversely to said slot in the region of said first end thereof; and a balun portion communicating with said first end of said slot, said balun portion having a high impedance and being configured to provide a selected degree of absorption of co-polarized electromagnetic energy.

2. An apparatus according to claim 1, wherein said degree of absorption is selected so that a percentage of energy which arrives through said conductive element and is absorbed is within a range of approximately 5% to 20%.

3. An apparatus according to claim 2, wherein said percentage of energy is with a range of approximately 9% to 15%.

4. An apparatus according to claim 3, wherein said percentage of energy is substantially 12%.

5. An apparatus according to claim 1, wherein said balun portion includes a resistive portion which facilitates said selected degree of absorption of electromagnetic energy.

6. An apparatus according to claim 5, wherein said resistive portion includes a sheetlike portion which extends approximately transversely to a centerline of said slot, and which is spaced from said first end of said slot.

7. An apparatus according to claim 5, wherein said balun portion includes a filler portion made of a material with a low dielectric constant.

8. An apparatus according to claim 7, wherein said resistive portion includes a sheetlike portion which extends approximately transversely to a centerline of said slot, and which is spaced from said first end of said slot; and wherein said filler portion includes first and second sections which are disposed on opposite sides of said sheetlike portion.

9. An apparatus according to claim 7, wherein said resistive portion includes first and second sheetlike portions which each extend approximately transversely to a centerline of said slot, and which are spaced from said first end of said slot by respective different distances; and wherein said filler portion includes first, second and third sections, said first sheetlike portion being disposed between said first and second sections, and said second sheetlike portion being disposed between said second and third sections.

10. An apparatus, comprising:

a slot section having electrically conductive material which defines a slot with first and second ends;

an electrically conductive element extending generally transversely to said slot in the region of said first end thereof;

a balun portion communicating with said first end of said slot, said balun portion having a high impedance and being configured to provide a selected degree of absorption of electromagnetic energy;

wherein said balun portion includes a resistive portion which facilitates said selected degree of absorption of electromagnetic energy; and wherein said resistive portion includes a plurality of sheetlike portions which each extend approximately transversely to a centerline of said slot, and which are spaced from said first end of said slot by respective different distances.

11. An apparatus, comprising:

a slot section having electrically conductive material which defines a slot with first and second ends;

an electrically conductive element extending generally transversely to said slot in the region of said first end thereof;

a balun portion communicating with said first end of said slot, said balun portion having a high impedance and being configured to provide a selected degree of absorption of electromagnetic energy;

wherein said balun portion includes a resistive portion which facilitates said selected degree of absorption of electromagnetic energy; and wherein said balun portion includes an electrically conductive portion which, within a plane containing the centerline of said slot, extends completely around said resistive portion, except where said first end of said slot communicates with said balun portion.

12. An apparatus, comprising:

a slot section having electrically conductive material which defines a slot with first and second ends;

an electrically conductive element extending generally transversely to said slot in the region of said first end thereof;

a balun portion communicating with said first end of said slot, said balun portion having a high impedance and being configured to provide a selected degree of absorption of electromagnetic energy;

wherein said balun portion includes a resistive portion which facilitates said selected degree of absorption of electromagnetic energy; and wherein said balun portion includes:

a filler portion made of a material with a low dielectric constant; and an electrically conductive portion which, within a plane containing the centerline of said slot, extends completely around said resistive portion and said filler portion, except where said first end of said slot communicates with said balun portion.

13. An apparatus, comprising:

a slot section having electrically conductive material which defines a plurality of slots that each have a first end and a second end;

a plurality of electrically conductive elements which each extend generally transversely to a respective said slot in the region of said first end thereof; and a plurality of balun portions which each communicate with said first end of a respective said slot, each said balun portion having a high impedance and being configured to provide a selected degree of absorption of co-polarized electromagnetic energy.

14. An apparatus according to claim 13, wherein said degree of absorption is selected so that a percentage of energy which arrives through each said conductive element and is absorbed is within a range of approximately 5% to 20%.

15. An apparatus according to claim 14, wherein said percentage of energy is with a range of approximately 9% to 15%.

16. An apparatus according to claim 15, wherein said percentage of energy is substantially 12%.

17. An apparatus according to claim 13, wherein each said balun portion includes a resistive portion which facilitates said selected degree of absorption of electromagnetic energy.

18. An apparatus according to claim 17, wherein said slots have centerlines which are all approximately parallel to each other; and including a sheet of resistive material which is spaced from said first end of said slot, which extends approximately transversely to the centerlines of said slots, and which has a plurality of portions that each serve as said resistive portion of a respective said balun portion.

19. An apparatus according to claim 17, wherein each said balun portion includes a filler portion made of a material with a low dielectric constant.

20. An apparatus according to claim 19, wherein said slots have centerlines which are all approximately parallel to each other;

including first and second sheets of resistive material which are spaced from said first end of said slot by respective different distances, which each extend approximately transversely to the centerlines of said slots, and which each have a plurality of portions that each serve as part of said resistive portion of a respective said balun portion; and including first, second and third layers which are made from said material with said low dielectric constant, and which each include a plurality of sections that each serve as a part of said filler portion of a respective said balun portion, said first sheet being disposed between said first and second layers and said second sheet being disposed between said second and third layers.

21. An apparatus according to claim 17, including an electrically conductive layer which extends approximately transversely to the centerlines of said slots and which is disposed on a side of said balun portions remote from said slots; and including a plurality of electrically conductive parts which are spaced from each other, which each extend approximately parallel to the centerlines of said slots, and which are electrically coupled to said electrically conductive layer and to the electrically conductive material of said slot section;

wherein each said balun portion includes portions of two of said parts and a portion of said electrically conductive layer which collectively serve as an electrically conductive portion that, within a plane containing the centerline of the associated slot, extends completely around said resistive portion of that balun portion, except where said first end of the associated slot communicates with that balun portion.

22. An apparatus according to claim 21, including a plurality of coaxial feeds which extend through said electrically conductive parts and which each have a center conductor with a portion that serves as a respective said electrically conductive element.

23. An apparatus according to claim 17, wherein each said balun portion includes a filler portion made of a material with a low dielectric constant;

including an electrically conductive layer which extends approximately transversely to the centerlines of said slots and which is disposed on a side of said balun portions remote from said slots; and including a plurality of electrically conductive parts which are spaced from each other, which each extend approximately parallel to the centerlines of said slots, and which are electrically coupled to said electrically conductive layer and to the electrically conductive material of said slot section;

wherein each said balun portion includes portions of two of said parts and a portion of said electrically conductive layer which collectively serve as an electrically conductive portion that, within a plane containing the centerline of the associated slot, extends completely around said resistive portion and said filler portion of that balun portion, except where said first end of the associated slot communicates with that balun portion.

24. An apparatus, comprising:

a slot section having electrically conductive material which defines a plurality of slots that each have a first end and a second end;

a plurality of electrically conductive elements which each extend generally transversely to a respective said slot in the region of said first end thereof;

a plurality of balun portions which each communicate with said first end of a respective said slot, each said balun portion having a high impedance and being configured to provide a selected degree of absorption of electromagnetic energy;

wherein each said balun portion includes a resistive portion which facilitates said selected degree of absorption of electromagnetic energy;

wherein said slots have centerlines which are all approximately parallel to each other; and including a plurality of sheets of resistive material which are spaced from said first end of said slot by respective different distances, which each extend approximately transversely to the centerlines of said slots, and which each have a plurality of portions that each serve as part of said resistive portion of a respective said balun portion.

25. An apparatus, comprising:

a slot section having electrically conductive material which defines a plurality of slots that each have a first end and a second end;

a plurality of electrically conductive elements which each extend generally transversely to a respective said slot in the region of said first end thereof;

a plurality of balun portions which each communicate with said first end of a respective said slot, each said balun portion having a high impedance and being configured to provide a selected degree of absorption of electromagnetic energy;

wherein each said balun portion includes a resistive portion which facilitates said selected degree of absorption of electromagnetic energy;

wherein each said balun portion includes a filler portion made of a material with a low dielectric constant;

wherein said slots have centerlines which are all approximately parallel to each other;

including a sheet of resistive material which is spaced from said first end of said slot, which extends approximately transversely to the centerlines of said slots, and which has a plurality of portions that each serve as said resistive portion of a respective said balun portion; and including first and second layers which are made from said material with said low dielectric constant and which each include a plurality of sections that each serve as a part of said filler portion of a respective said balun portion, said sheet of resistive material being disposed between said first and second layers.

26. A method of operating an apparatus which includes a slot section having electrically conductive material which defines a slot with first and second ends, an electrically conductive element extending generally transversely to said slot in the region of said first end thereof, and a balun portion communicating with said first end of said slot, comprising:

configuring said balun portion to have a high impedance; and absorbing a selected degree of co-polarizing electromagnetic energy in said balun portion.

27. An apparatus according to claim 26, including selecting said degree of absorption so that a percentage of energy which arrives through said conductive element and is caused to travel through said slot toward said second end thereof is within a range of approximately 80% to 95%.

28. An apparatus according to claim 27, wherein said selecting of said degree of absorption is carried out so that said percentage of energy is within a range of approximately 85% to 90%.

29. An apparatus according to claim 28, wherein said selecting of said degree of absorption is carried out so that said percentage of energy is substantially 88%.

30. An apparatus according to claim 26, including configuring said balun portion to include a resistive portion which facilitates said selected degree of absorption of electromagnetic energy.

31. An apparatus according to claim 30, including configuring said balun portion to include a filler portion made of a material with a low dielectric constant.

* * * * *